US006630791B2

(12) United States Patent
Uchida et al.

(10) Patent No.: US 6,630,791 B2
(45) Date of Patent: Oct. 7, 2003

(54) CATHODE RAY TUBE DEVICE THAT REDUCES MAGNETIC FIELD LEAKAGE

(75) Inventors: Yukio Uchida, Ibaraki (JP); Tomoaki Iwamoto, Katano (JP); Katsuyo Iwasaki, Nishinomiya (JP)

(73) Assignee: Matsushita Electric Industrial Co., LTD, Osaka-Fu (JP)

( * ) Notice: Subject to any disclaimer, the term of this patent is extended or adjusted under 35 U.S.C. 154(b) by 0 days.

(21) Appl. No.: 10/120,326

(22) Filed: Apr. 10, 2002

(65) Prior Publication Data

US 2002/0109461 A1 Aug. 15, 2002

Related U.S. Application Data

(63) Continuation of application No. 09/536,038, filed on Mar. 27, 2000, now Pat. No. 6,404,133.

(30) Foreign Application Priority Data

Mar. 31, 1999 (JP) ..... 11-92559

(51) Int. Cl.[7] ..... H01J 1/52; H01J 29/80; H01H 1/00

(52) U.S. Cl. ..... 315/85; 315/8; 315/370; 313/402; 313/408; 335/214; 335/213

(58) Field of Search ..... 315/85, 8, 370, 315/399; 313/440, 402, 408, 429, 413; 335/214, 213

(56) References Cited

U.S. PATENT DOCUMENTS

| | | | | | |
|---|---|---|---|---|---|
| 5,049,847 | A | * | 9/1991 | Okuyama et al. | 335/214 |
| 5,115,170 | A | | 5/1992 | Ose et al. | 315/370 |
| 5,200,673 | A | | 4/1993 | Hishiki | 315/370 |
| 5,350,973 | A | | 9/1994 | Yokota et al. | 315/8 |
| 5,379,117 | A | | 1/1995 | Yang | 358/400 |
| 5,404,121 | A | * | 4/1995 | Cho | 335/214 |
| 5,744,904 | A | | 4/1998 | Chang-Fa | 313/479 |
| 5,786,668 | A | | 7/1998 | Lim et al. | 315/85 |
| 6,404,133 | B1 | * | 6/2002 | Uchida et al. | 315/85 |

FOREIGN PATENT DOCUMENTS

| | | |
|---|---|---|
| EP | 523741 | 1/1993 |
| JP | 3165428 | 7/1991 |
| JP | 5207404 | 8/1993 |
| JP | 6176714 | 6/1994 |
| JP | 11144647 | 5/1999 |

* cited by examiner

*Primary Examiner*—Don Wong
*Assistant Examiner*—Tuyet T. Vo

(57) ABSTRACT

Two closed-loop coils are respectively set at the top or the bottom of a cathode ray tube. These two closed-loop coils serves in a pair as a cancel coil. Each closed-loop coil is positioned so as to make an interlinkage with the magnetic field leakage that escapes from the deflection yoke, a part of the closed-loop coil running almost in parallel to the top or bottom edge of an effective display region of a front panel.

9 Claims, 13 Drawing Sheets

Fig. 7

| measurement position(° ) | magnetic field leakage(nT) | |
|---|---|---|
| | prior art | present invention |
| 0° | 22.9 | 20.4 |
| 22° | 22.2 | 19.9 |
| 45° | 19.5 | 17.2 |
| 67° | 15.2 | 12.6 |
| 90° | 10.9 | 9.1 |
| 112° | 8.1 | 7.8 |
| 135° | 7.2 | 8.1 |
| 157° | 6.7 | 7.8 |
| 180° | 6.1 | 6.8 |
| 202° | 6.6 | 7.2 |
| 225° | 7.9 | 8.5 |
| 247° | 9.2 | 9.3 |
| 270° | 11.1 | 10.6 |
| 292° | 14.8 | 13.6 |
| 315° | 18.9 | 16.8 |
| 337° | 21.8 | 19.1 |

Fig. 9

| measurement position | electric field leakage(V/m) | |
|---|---|---|
| | prior art | present invention |
| at a distance of 30cm from the front panel | 5.6 | 3.7 |
| at a distance of 50cm from the front panel | 2.4 | 1.2 |

Fig. 14

| measurement position(° ) | magnetic field leakage(nT) | |
|---|---|---|
| | prior art | present invention |
| 0° | 22.9 | 19.3 |
| 22° | 22.2 | 19.0 |
| 45° | 19.5 | 16.9 |
| 67° | 15.2 | 12.1 |
| 90° | 10.9 | 8.7 |
| 112° | 8.1 | 7.5 |
| 135° | 7.2 | 8.3 |
| 157° | 6.7 | 8.0 |
| 180° | 6.1 | 7.0 |
| 202° | 6.6 | 7.3 |
| 225° | 7.9 | 8.6 |
| 247° | 9.2 | 8.9 |
| 270° | 11.1 | 10.0 |
| 292° | 14.8 | 12.8 |
| 315° | 18.9 | 16.0 |
| 337° | 21.8 | 18.2 |

Fig. 15

| measurement position | electric field leakage(V/m) | |
|---|---|---|
| | prior art | present invention |
| at a distance of 30cm from the front panel | 5.6 | 0.8 |
| at a distance of 50cm from the front panel | 2.4 | 0.5 |

CATHODE RAY TUBE DEVICE THAT REDUCES MAGNETIC FIELD LEAKAGE

RELATED APPLICATIONS

This is a continuation application of U.S. Ser. No. 09/536,038, filed on Mar. 27, 2000 now U.S. Pat. No. 6,404,138.

BACKGROUND OF THE INVENTION (1) Field of the Invention

The present invention relates to a cathode ray tube (CRT) device provided with a deflection yoke, and particularly relates to a technique for reducing a magnetic field escaping as leakage from the deflection yoke.

(2) Related Art

In recent years, standards have been developed in Northern Europe in response to concerns about a low-frequency magnetic field given off by a CRT device. There is apprehension that such a magnetic field may affect the human body. Especially in Sweden, the standards, such as the MPR II and TCO standards, have been established with the aim of suppressing the magnetic field escaping from a deflection yoke or a horizontal deflection coil in particular. The magnetic field escaping as leakage from the deflection yoke or the horizontal deflection coil is referred to as the "magnetic field leakage" hereinafter. To meet the leakage limits prescribed by the standards, necessary measures should be taken for the CRT device to reduce the magnetic field leakage.

There have been techniques suggested in order to reduce the magnetic field leakage. As one example of such techniques, a magnetic field is generated as a "cancel magnetic field" in the direction opposite to the magnetic field escaping as leakage from the deflection yoke. For doing so, a "cancel coil" is used for generating the cancel magnetic field so as to cancel the magnetic field leakage.

A CRT device using a cancel coil is disclosed in Japanese Laid-Open Patent Application No. 3-165428 (referred to as the first prior art) and No. 6-176714 (referred to as the second prior art).

For the CRT device disclosed in the first prior art, a cancel coil for reducing the magnetic field leakage is set above an upper part of a deflection yoke and a current is supplied to the cancel coil so that a cancel magnetic field is generated. FIG. 1 shows a schematic circuit diagram of a horizontal deflection coil 27 and a cancel coil 28 of the first prior art.

As shown in FIG. 1, the horizontal deflection coil 27 and the cancel coil 28 are connected in series. By the passage of a horizontal deflection current through the cancel coil 28 as well as the horizontal deflection coil 27, the cancel coil 28 can generate a cancel magnetic field that varies in accordance with the variations in the magnetic field leakage from the horizontal deflection coil 27. The cancel coil 28 is positioned so that the cancel magnetic field is generated in a proper direction to cancel the magnetic field leakage.

Meanwhile, for the CRT device disclosed in the second prior art, a cancel coil for reducing the magnetic field leakage is made up of a closed-circuit winding and set at each of upper and lower parts of a CRT so as to face a deflection yoke. FIG. 2 shows a schematic circuit diagram of a horizontal deflection coil 37 and a cancel coil 38 of the second prior art.

As shown in FIG. 2, the cancel coil 38 made up of the closed-circuit winding is set facing the horizontal deflection coil 37. With this construction, an electromotive force is produced inside the cancel coil 38 in accordance with variations in the magnetic field leakage resulting from the generation of the horizontal deflection magnetic field. By means of the electromotive force, the cancel coil 38 generates a cancel magnetic field in a proper direction so as to cancel the magnetic field leakage.

However, the CRT devices employing the techniques stated in the first and second prior arts respectively have the following problems.

As for the first prior art, the deflection current needs to pass through the cancel coil 28 that does not contribute to the horizontal deflection. Thus, power has to be unnecessarily consumed and, in addition to this, the deflection sensitivity may be deteriorated.

As for the second prior art, power does not need to be supplied to the cancel coil 38 and so the problem of the first prior art does not occur. However, the second prior art has another problem. If the magnetic field escaping as leakage from the deflection yoke is harmful to the human body, the magnetic field leakage should be reduced in front of a front panel of the CRT device, where a user is expected to be most times. However, the cancel coils 38 are set at the upper and lower parts of the CRT, facing the deflection yoke, so that the magnetic field leakage cannot be effectively reduced at a significant position where the reduction of leakage is required most. In order to reduce the magnetic field leakage at this position, the number of turns forming the cancel coil 38 may be increased. However, the increased number of turns of the cancel coil 38 may in turn adversely affect the horizontal deflection magnetic field.

Just as with the magnetic field leakage, electric field leakage is also subject to the Swedish MPR II and TCO standards. The electric field leakage is ascribable mainly to that an electric field generated due to a difference in voltage between the facing deflection coils included in the deflection yoke is given off to the outside. A technique for reducing such an electric field leakage is disclosed in, for example, Japanese Laid-Open Patent Application No. 5-207404 (referred to as the third prior art).

For the CRT device disclosed in the third prior art, a reverse voltage supplying unit is provided to supply a voltage having a reversed polarity to the waveform of the deflection voltage applied to a deflection coil. Also, an electrode is set at the top and bottom of the inner wall of the CRT at the front panel side. The reverse voltage supplying unit supplies the reverse voltage to the pair of electrodes. This enables the electrodes to generate an electric field having the reversed polarity to the VLMF (Very Low Magnetic Field) leakage (i.e., unwanted VLMF leakage). The electric field with the reversed polarity can cancel the unwanted VLMF leakage.

Using the technique of the third prior art, however, the reverse voltage supplying unit needs to be further provided. In addition to this, the magnetic field leakage cannot be reduced using this technique.

SUMMARY OF THE INVENTION

Therefore, it is a first object of the present invention to provide a CRT device that can prevent unnecessary power consumption and reduce a magnetic field leakage with a simple construction at low costs.

It is a second object of the present invention to provide a CRT device that can prevent unnecessary power consumption and reduce magnetic and electric field leakages with a simple construction at low costs.

The first object of the present invention can be achieved by a cathode ray tube device made up of: a cathode ray tube that has a front panel and a funnel; an electron gun that is set inside a neck of the funnel and projects electron beams onto an inner surface of the front panel; a deflection yoke that is set on the funnel at the neck and deflects the electron beams projected by the electron gun; and a cancel coil that has at least one closed-loop coil, makes an interlinkage with a magnetic field leakage that escapes from the deflection yoke, and generates a magnetic field in a direction so as to cancel the magnetic field leakage, wherein each closed-loop coil is set at either a first position or a second position, the first position being at a top of the cathode ray tube with a part of the closed-loop coil running along a top edge of an effective display region of the front panel, and the second position being at a bottom of the cathode ray tube with a part of the closed-loop coil running along a bottom edge of the effective display region.

With this construction, the magnetic field leakage from the CRT makes an interlinkage with the closed-loop coil, so that the magnetic field leakage can be canceled. Since the closed-loop coil is arranged along the top or bottom edge of the effective display region, the magnetic field leakage occurring at a significant position where the reduction of leakage is required most can make an interlinkage with the closed-loop coil. Consequently, the effect of canceling the magnetic field leakage can be attained at the maximum in practical terms without interfering with the image display.

It is preferable that the closed-loop coil of the cathode ray tube device further runs near right and left corners of the front panel and near an opening of the deflection yoke at a front panel side.

By doing so, the magnetic field leakage occurring in a space from the front panel to the opening of the horizontal coil at the front panel side makes an interlinkage with the closed-loop coil. As a result, the magnetic field leakage can be more effectively canceled.

The second object of the present invention can be achieved by the cathode ray tube device, wherein the closed-loop coil of the cancel coil is grounded at one point of the closed-loop coil. To be more specific, the closed-loop coil serves as a shield against the electric field leakage and so reduces the electric field escaping as leakage from the deflection yoke.

The second object of the present invention can be also achieved by a cathode ray tube device made up of: a cathode ray tube that has a front panel and a funnel; an electron gun that is set inside a neck of the funnel and projects electron beams onto an inner surface of the front panel; a deflection yoke that includes a horizontal deflection coil, and is set on the funnel at the neck and deflects the electron beams projected by the electron gun; a first coil through which a current passes, the current varying in synchronization with variations in a deflection current passing through the horizontal deflection coil; and a second coil that has at least one closed-loop coil, makes an interlinkage with any magnetic field leakage that escapes from the deflection yoke, and generates a magnetic field in a direction so as to cancel the magnetic field leakage, wherein a part of each closed-loop coil is magnetically coupled to the first coil so that an electromotive force is produced for causing a magnetic field in the same direction as the magnetic field generated through the interlinkage with the magnetic field linkage, whereby the magnetic field leakage is further canceled.

With this construction, the electromotive force is produced inside the closed-loop coil through the magnetic coupling between the closed-loop coil and the first coil through which the current varying in synchronization with the horizontal deflection current passes. By means of the electromotive force, the closed-loop coil generates the magnetic field (i.e., the cancel magnetic field) in the proper direction to further cancel the magnetic field leakage. As compared with a case where the closed-loop coil is not magnetically coupled to the first coil, a stronger cancel magnetic field can be generated. In addition, the strength of the cancel magnetic field can be easily adjusted by adjusting the strength of the magnetic coupling.

It is preferable that the part of the closed-loop coil of the cathode ray tube device is set around the correction coil for a magnetic coupling to the correction coil. By doing so, the magnetic coupling between the closed-coil loop and the differential coil can be easily achieved. The strength of the cancel magnetic field can be adjusted by changing the number of turns of the closed-loop coil to be set around the first coil.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 7 is a table showing results of measuring magnetic field leakages in the first embodiment;

FIG. 9 is a table showing results of measuring electric field leakages in the first embodiment;

FIG. 14 is a table showing results of measuring magnetic field leakages in the second embodiment; and FIG. 15 is a table showing results of measuring electric field leakages in the second embodiment.

DESCRIPTION OF PREFERRED EMBODIMENTS

The following is a description of embodiments of the present invention, with reference to the drawings.

First Embodiment

Figure 1:
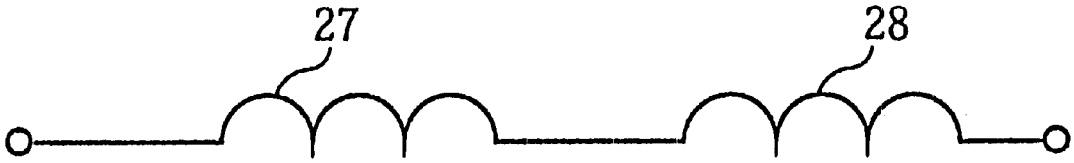
Fig. 1 PRIOR ART
FIG. 1 is a schematic circuit diagram of a horizontal deflection coil and a cancel coil of the first prior art.
Figure 2:
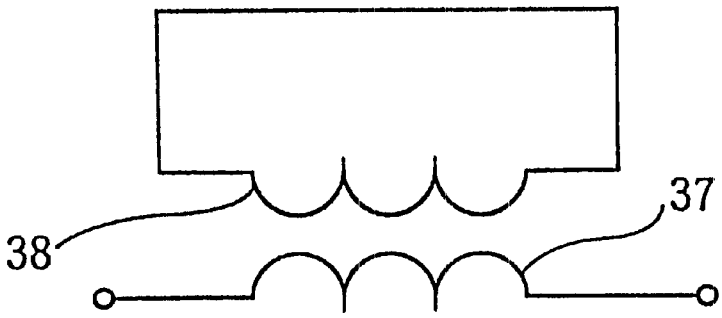
Fig. 2 PRIOR ART
FIG. 2 is a schematic circuit diagram of a horizontal deflection coil and a cancel coil of the second prior art.
Figure 3:
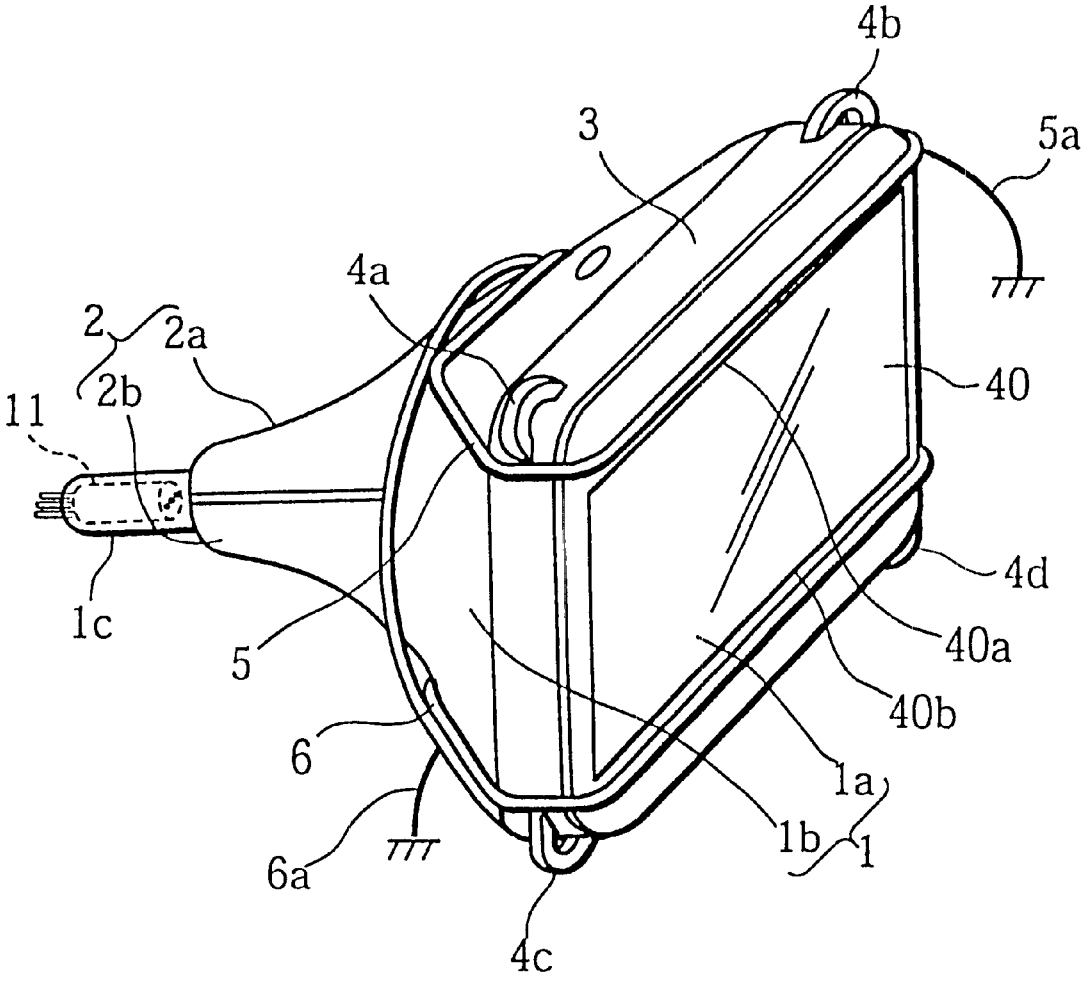
FIG. 3 is a perspective external view of a CRT device of a first embodiment of the present invention.
Figure 4:
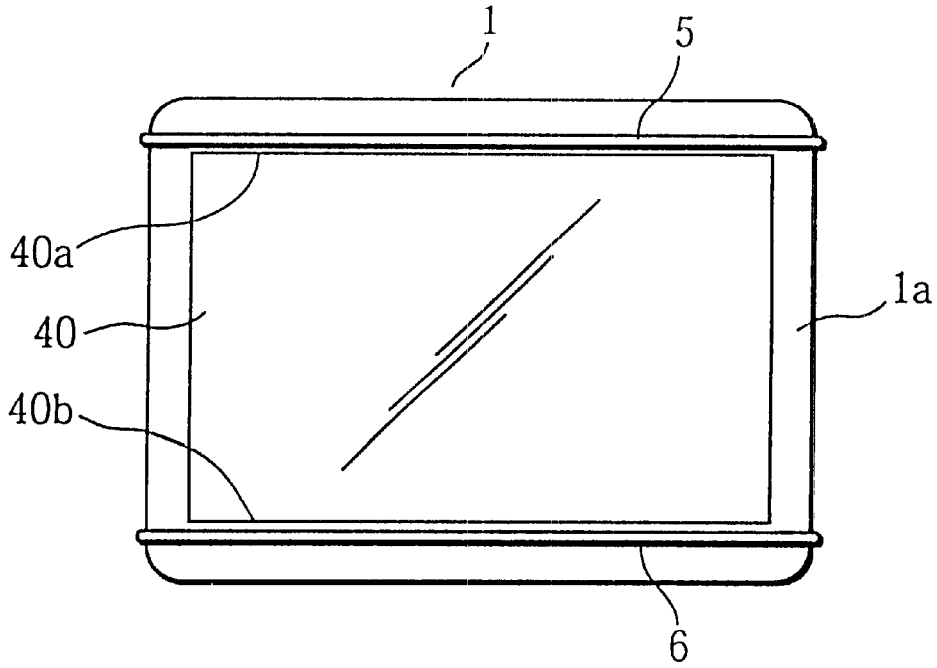
FIG. 4 is a schematic front view of the CRT device of the first embodiment.

FIG. 3 is a perspective external view of a CRT device of the first embodiment of the present invention. FIG. 4 is a schematic front view of the CRT device while FIG. 5 is a rear view of the CRT device.

As shown in FIG. 3, the CRT device of the present embodiment is composed of a CRT 1, a deflection yoke 2, an electron gun 11, a reinforcing band (or, flameproof band) 3, a first closed-loop coil 5, and a second closed-loop coil 6. The CRT 1 is made up of a front panel 1*a* and a funnel 1*b*. The deflection yoke 2 is made up of an upper (the north pole side) horizontal deflection coil 2*a*, a lower (the south pole side) horizontal deflection coil 2*b*, a vertical deflection coil (not illustrated), and a core (not illustrated). The electron gun 11 is set inside a neck 1*c*. The reinforcing band 3 is set on the outer edge of the front panel 1*a*.

The reinforcing band 3 is usually made of metal, and is set so as to securely cover a connection part of the front panel 1*a* and the funnel 1*b* for the purpose of protecting the CRT device from fire or heat. First to fourth ear-shaped members (simply referred to as "ears") 4*a* to 4*d* are respectively formed on the four corners of the reinforcing band 3. Note that the reinforcing band 3 and the first to fourth ears 4*a* to 4*d* are not illustrated in FIG. 4 for convenience of explanation.

Figure 5:
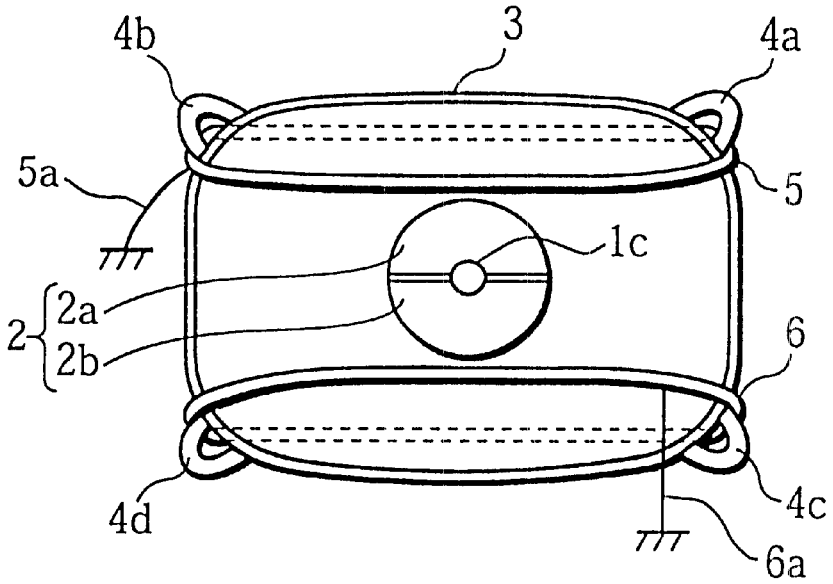
FIG. 5 is a rear view of the CRT device of the first embodiment.

As shown in FIG. 4 and FIG. 5, the first closed-loop coil 5 is set at an upper part of the front panel 1*a*. To be more specific, the first closed-loop coil 5 is arranged just above a top edge 40*a* of an effective display region 40 within which the electron beams perform raster scanning on the fluorescent screen. Simultaneously, the first closed-loop coil 5 is arranged under the first and second ears 4*a* and 4*b*, and near an opening of the upper horizontal deflection coil 2*a* at the front panel side. Meanwhile, the second closed-loop coil 6 is set at a lower part of the front panel 1*a*. To be more specific, the second closed-loop coil 5 is arranged just below a bottom edge 40*a* of the effective display region 40 and, simultaneously, arranged above the third and fourth ears 4*c* and 4*d*, and near an opening of the lower horizontal deflection coil 2*b* at the front panel side. The first and second closed-loop coils 5 and 6 are fixed to the CRT 1 and the reinforcing band 3 by an adhesive or a self-adhesive tape so that they will not become misaligned.

The first and second closed-loop coils 5 and 6 are respectively arranged under the ears 4*a* and 4*b*, and above the ears 4*c* and 4*d*, and are further arranged in such a manner that they surround the front panel 1*a* and the funnel 1*b* of the CRT 1. With this arrangement, the magnetic field leakage from the front panel 1*a* or the funnel 1*b* to the outside makes an interlinkage with the first closed-loop coil 5 or the second closed-loop coil 6.

The first and second closed-loop coils 5 and 6 are also respectively arranged at the upper and lower horizontal deflection coils 2*a* and 2*b* at the front panel side. With this arrangement, the magnetic field given off to the front of the deflection yoke 2 also makes interlinkages with the first and second closed-loop coils 5 and 6.

It is a known fact that the magnetic field leakage in the vertical direction is caused due primarily to the horizontal deflection magnetic field. This means that the magnetic field leakage varies in accordance with cyclic variations in the horizontal deflection magnetic field. Meanwhile, electromotive forces that interfere with the variations in the horizontal deflection magnetic field are produced for the first and second closed-loop coils 5 and 6. With the electromotive force, each of the first and second closed-loop coils 5 and 6 generates a magnetic field, i.e., the cancel magnetic field, in the direction opposite to the magnetic field leakage. The cancel magnetic field can reduce the magnetic field leakage by canceling the leakage occurring in a broad space from the front panel 1*a*, that is nearest to the user, to the vicinity of a source of leakage.

The first and second closed-loop coils 5 and 6 are respectively grounded via earth wires 5*a* and 6*a*. Thus, the electric field leakage is shielded and so prevented from increasing.

Figure 6:
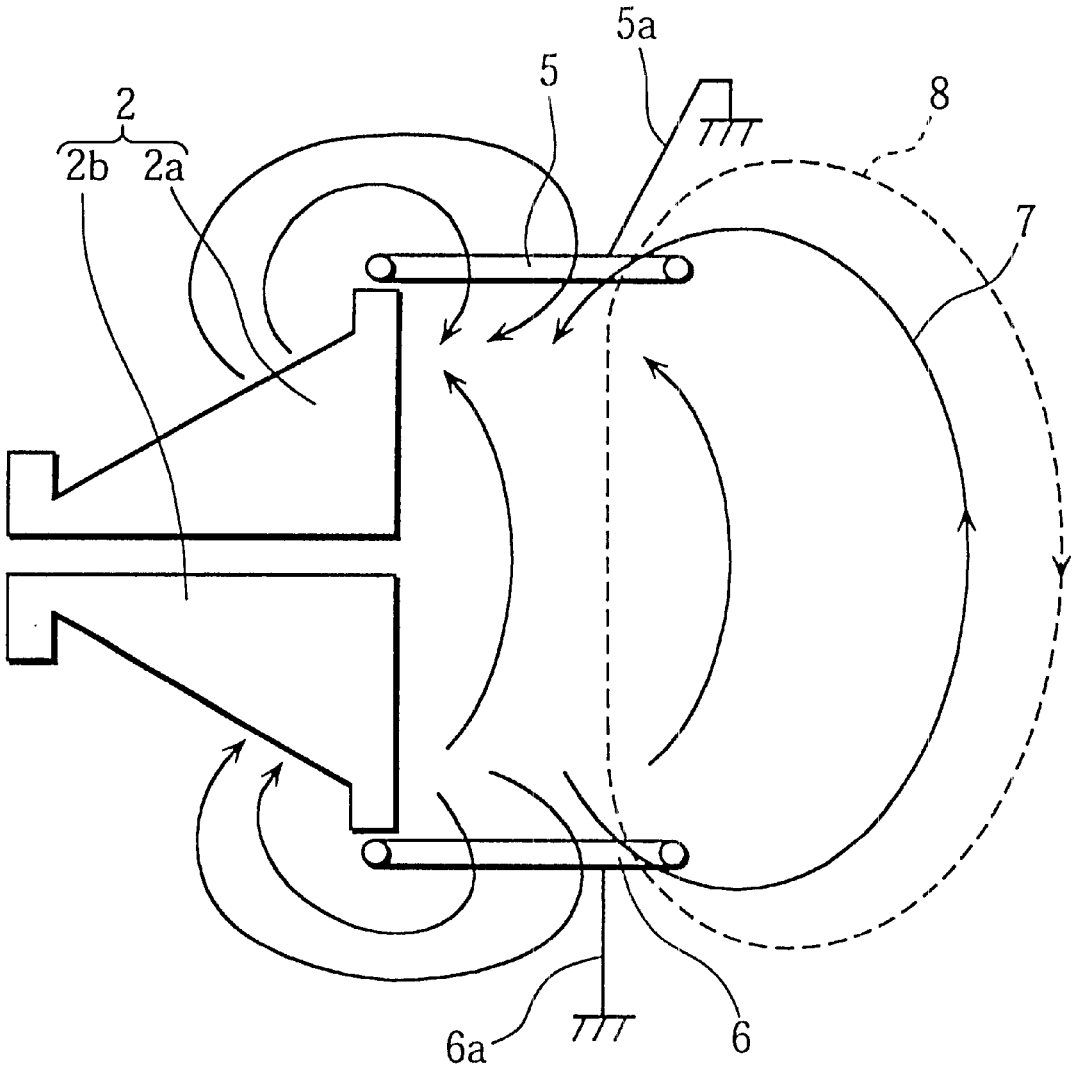
FIG. 6 is a view to help explain the relation between a cancel magnetic field generated by closed-loop coils and a magnetic field leakage from a deflection yoke, the relation being viewed from the left side of the CRT device shown in FIG. 4.
Figure 8:
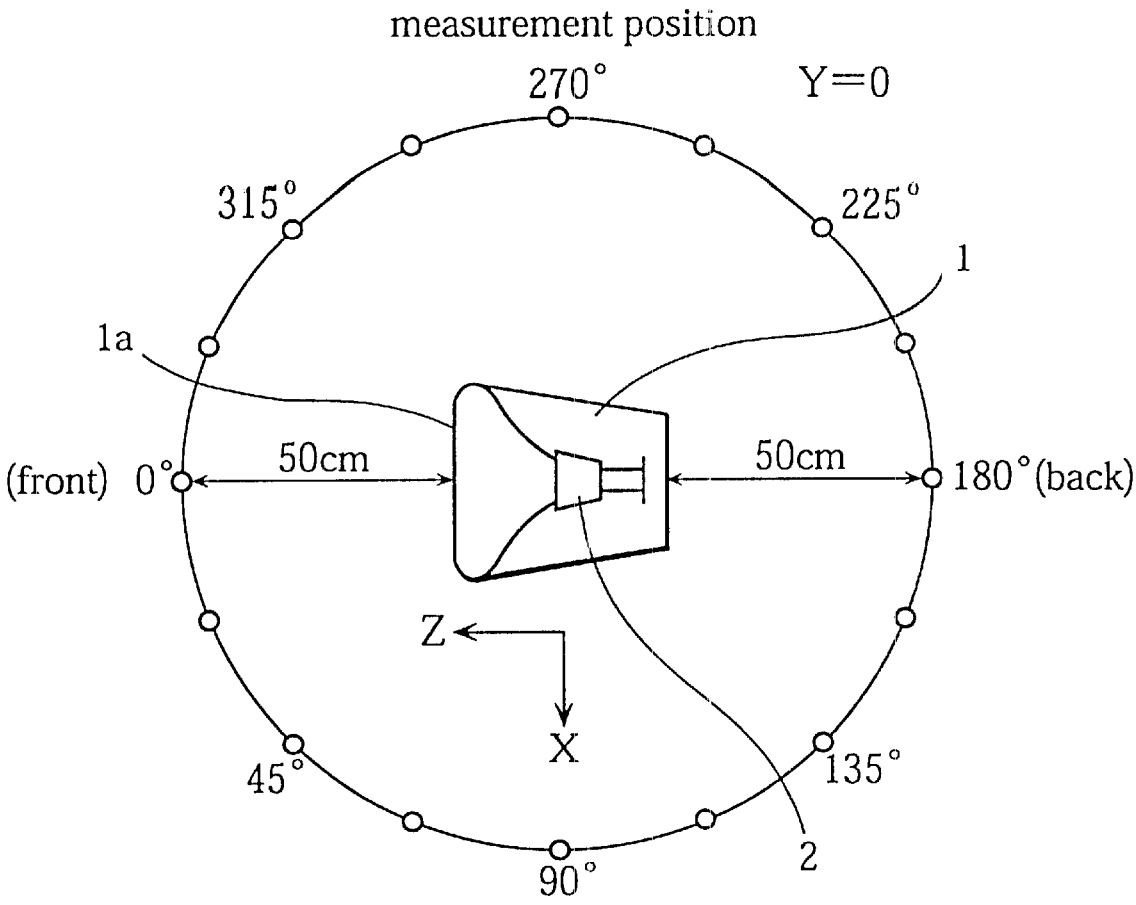
FIG. 8 shows positions at which the magnetic field leakages are measured.

Effects of reducing the magnetic and electric field leakages are explained in detail. FIG. 6 is a view to help explain the relation between the cancel magnetic field generated by the first and second closed-loop coils 5 and 6 and the magnetic field escaping as leakage from the deflection yoke 2, the relation being viewed from the left side of the CRT device shown in FIG. 4.

As stated earlier, the first closed-loop coil 5 is arranged at the upper front of the deflection yoke 2 while the second closed-loop coil 6 is arranged at the lower front of the deflection yoke 2 in the present embodiment. As such, a magnetic field leakage 7 from the deflection yoke 2 makes interlinkages with the first and second closed-loop coils 5 and 6. Here, in accordance with the cyclic variations in the magnetic field leakage 7, induced currents pass through the first and second closed-loop coils 5 and 6, so that the cancel magnetic field 8 is generated. As seen in FIG. 6, the first and second closed-loop coils 5 and 6 serve in a pair as a cancel coil for generating the cancel magnetic field 8.

The cancellation effect on the magnetic field leakage 7 varies depending on the setting position of each closed-loop coil 5 and 6. In the present embodiment, each setting direction of the first and second closed-loop coils 5 and 6 is appropriately determined so that the cancel magnetic field 8 with the reversed polarity is generated and effectively cancels the magnetic field leakage 7.

It is ideal for the first and second closed-loop coils 5 and 6 to horizontally cross the effective display region 40 of the front panel 1*a* and situated in a plane parallel to the axis of the CRT 1, although this arrangement certainly blocks the user's view. With this ideal arrangement of the coils 5 and 6, the directions of vectors of the magnetic field leakage 7 and the cancel magnetic field 8 are opposite to each other, so that the magnetic field leakage 7 can be most effectively canceled. This is because, as shown in FIG. 6, each of the closed-loop coils 5 and 6 is set so that a plane including the closed-loop coil 5 or 6 is perpendicular to a plane including the magnetic field leakage 7, meaning that the cancel magnetic field whose vector is different from that of the leakage by 180° is generated from the closed-loop coils 5 and 6.

The state shown in FIG. 6 is ideal for the cancellation of the magnetic field leakage. In reality, as stated, if the first and second closed-loop coils 5 and 6 horizontally crossed the effective display region 40 of the front panel 1*a*, they would block the user's view. As a matter of course, the arrangement to achieve the state shown in FIG. 6 cannot be employed for the CRT device of the present invention.

In the present embodiment, the first and second closed-loop coils 5 and 6 are respectively set along the top edge 40*a* and the bottom edge 40*b* of the effective display region 40, as shown in FIG. 4, so as to attain the maximum cancellation effect in practical applications. As can be readily understood, the respective setting positions of the closed-loop coils 5 and 6 present no problem for practical uses.

It is more preferable to set a closed-loop coil as a cancel coil at the upper and lower parts of the front panel 1*a* as in the case of the present embodiment. However, the closed-loop coil may be set at either the upper or the lower part of the front panel 1*a*. With the closed-loop coil set only at the upper part, the magnetic field escaping as leakage from the upper part of the deflection yoke 2 will be mainly canceled. Meanwhile, with the closed-loop coil set only at the lower part of the front panel 1*a*, the magnetic field escaping as leakage from the lower part of the deflection yoke 2 will be mainly canceled. It should be obvious that the magnetic fields escaping from the upper and lower parts of the deflection yoke 2 can be effectively canceled when the closed-loop coil is set at both the upper and lower parts of the front panel 1*a*.

The cancel coil may be composed of more than two closed-loop coils. For example, when three closed-loop coils are used as the cancel coil, two coils may be set at the upper part of the CRT 1 while a remaining closed-loop coil may be set at the lower part of the CRT 1.

Since the first and second closed-loop coils 5 and 6 are respectively grounded via the earth wires 5*a* and 5*b*, the closed-loop coils 5 and 6 are at the same earth potential. As such, there has to be no difference in voltage of electromotive force between the first and second closed-loop coils 5 and 6, so that no electric field will be generated between the closed-loop coils 5 and 6. Therefore, not only is unnecessary electric field leakage prevented from increasing, but also the electric field leakage is reliably reduced owing to the closed-loop coils 5 and 6 serving as the shields against the electric field that is to escape as leakage from the deflection yoke 2.

<Experiments>

An experiment was conducted using a 40-centimeter (17-inch) computer monitor employing the CRT device of the present embodiment. In the experiment, the magnetic field leakages were measured to see the reduction effect in comparison with a conventional device.

A closed-loop coil used in the present experiment was made of a multifilament copper wire (KV0.75 type) covered with vinyl. The perimeter of the closed-loop coil was about 110 cm. Two closed-loop coils, as the first and second closed-loop coils 5 and 6, were respectively set along the top edge 40*a* and the bottom edge 40*b* of the effective display region 40, as shown in FIG. 4. In the case of the 40-centimeter computer monitor, the front panel 1*a* is 29.5 cm high and 37.2 cm wide, and the effective display region 40 is 24.3 cm high and 32.4 cm wide.

FIG. 7 is a table showing the results of magnetic field leakages measured outside the CRT device (i.e., the computer monitor) in comparison with the conventional CRT device having no closed-loop coils. The degrees in the leftmost column represent positions at which the measurements were taken (the positions are referred to as the "measurement positions" hereinafter). All of the measurement positions lie on an imaginary circle that passes through two points respectively situated at a distance of 50 cm from the front and the back of the CRT device. The degrees representing the measurement positions were measured from the point at a distance of 50 cm from the front of the CRT device (indicated as 0°) in a counterclockwise direction.

As can be seen from the table shown in FIG. 7, in comparison with the case of the conventional device that was not provided with the cancel coil, the magnetic field leakage were reduced using the present invention at the measurement positions except for the several positions located behind the CRT device. The magnetic field leakage at the 0° measurement position, at which the leakage is the greatest in general, was reduced to 20.4 nT while it was 22.9 nT in the case of the conventional device. According to the Swedish MPR II standard, the magnetic field leakage has to be equal to or less than 25 nT at this position. The magnetic field leakages of the CRT device of the present embodiment were sufficiently below this prescribed limit. As shown in the table, the magnetic field leakages of the conventional CRT device having no cancel coil were also sufficiently below the limit of 25 nT. However, the leakages can easily exceed the limit due to irregularities of produced components to be provided for a CRT device. In the present embodiment, by reducing the magnetic field leakage with a higher intention, the leakage can be reliably below the limit for any produced CRT device.

Next, another experiment was conducted to measure the electric field leakages and see the reduction effect in comparison with the conventional device. The closed-loop coils, that have been tested and shown to have the reduction effect on the magnetic field leakage in the above experiment, were grounded for the present experiment. With this construction, the closed-loop coils served as shields against the electric field that is to escape, thereby reducing the electric field leakage. In the present experiment, the measurements were taken at distances of 50 cm and 30 cm in front of the CRT device. The results are shown in the table of FIG. 9.

As shown in the table, the electric field leakage was 1.2 V/m at a distance of 50 cm in front of the CRT device. This leakage value sufficiently below the limit of 2.5 V/m prescribed in the Swedish MPR II standard.

Second Embodiment

Figure 10:
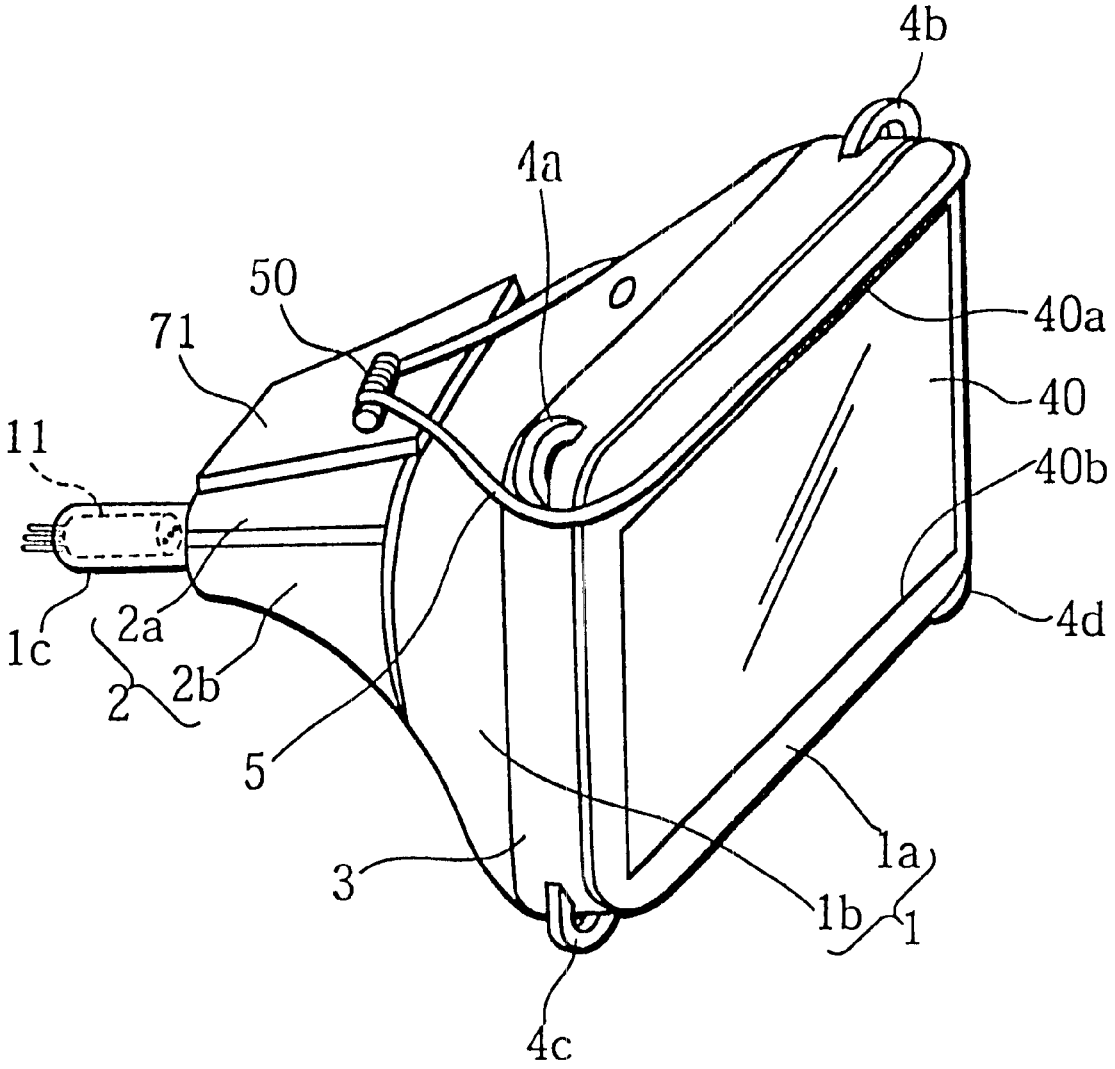
FIG. 10 is a perspective external view of a CRT device of a second embodiment of the present invention.

FIG. 10 is a perspective external view of a CRT device of the second embodiment of the present invention. The CRT device of the second embodiment is composed of a CRT 1, a deflection yoke 2, an electron gun 11, a reinforcing band (or, flameproof band) 3, and a closed-loop coil 5. The CRT 1 is made up of a front panel 1*a* and a funnel 1*b*. The deflection yoke 2 is made up of an upper horizontal deflection coil 2*a*, a lower horizontal deflection coil 2*b*, a vertical deflection coil (not illustrated), and a core (not illustrated). The reinforcing band 3 is set on the outer edge of the front panel la, and first to fourth ears 4*a* to 4*d* are respectively formed on the four corners of the reinforcing band 3.

The closed-loop coil 5 is set at an upper part of the CRT device. To be more specific, the closed-loop coil 5 is arranged just above a top edge 40*a* of an effective display region 40 of the front panel 1*a*. Simultaneously, the closed-loop coil 5 is arranged under the first and second ears 4*a* and 4*b*, and near an opening of the upper horizontal deflection coil 2*a* at the front panel side.

A board 71 made of insulation material is mounted on the upper horizontal deflection coil 2*a* via a mounting member (not illustrated). The board 71 is equipped with a differential coil 50 as a well-known coil for correcting cross-misconvergence. A part of the closed-loop coil 5 is set around the differential coil 50, so that the closed-loop coil 5 can obtain an induced electromotive force from the differential coil 50.

Figure 11A:
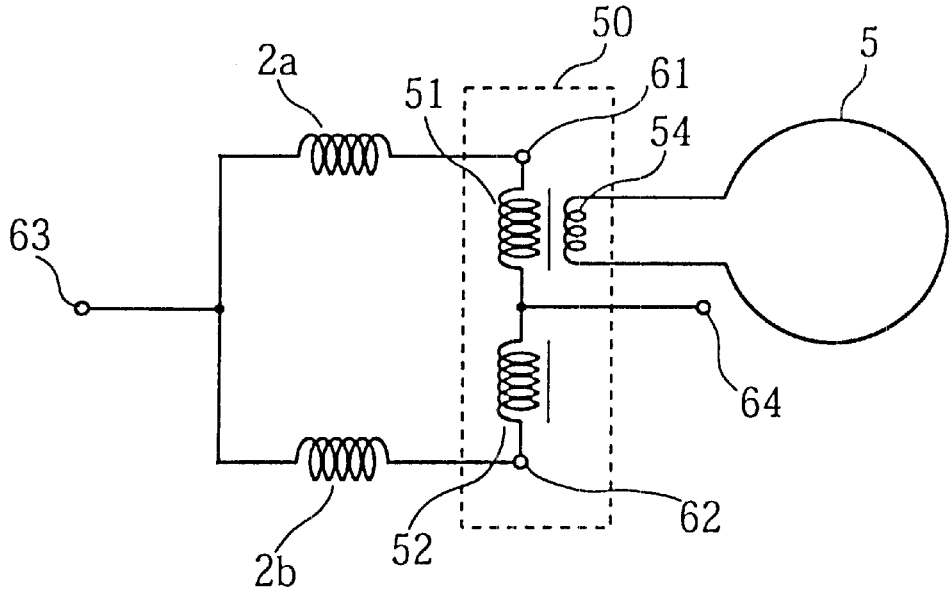
FIG. 11A is a schematic circuit diagram of a horizontal deflection coil, a differential coil, and a closed-loop coil of the CRT device of the second embodiment.

FIG. 11A is a schematic circuit diagram of the horizontal deflection coil 2, the differential coil 50, and the closed-loop coil 5. As shown in this circuit diagram, coils 51 and 52 comprising the differential coil 50 are respectively connected in series with the upper and lower horizontal deflection coils 2*a* and 2*b* via terminals 61 and 62. The closed-loop coil 5 is magnetically coupled to the differential coil 50. This circuit is connected to output terminals of a horizontal deflection circuit via terminals 63 and 64.

Figure 11B:
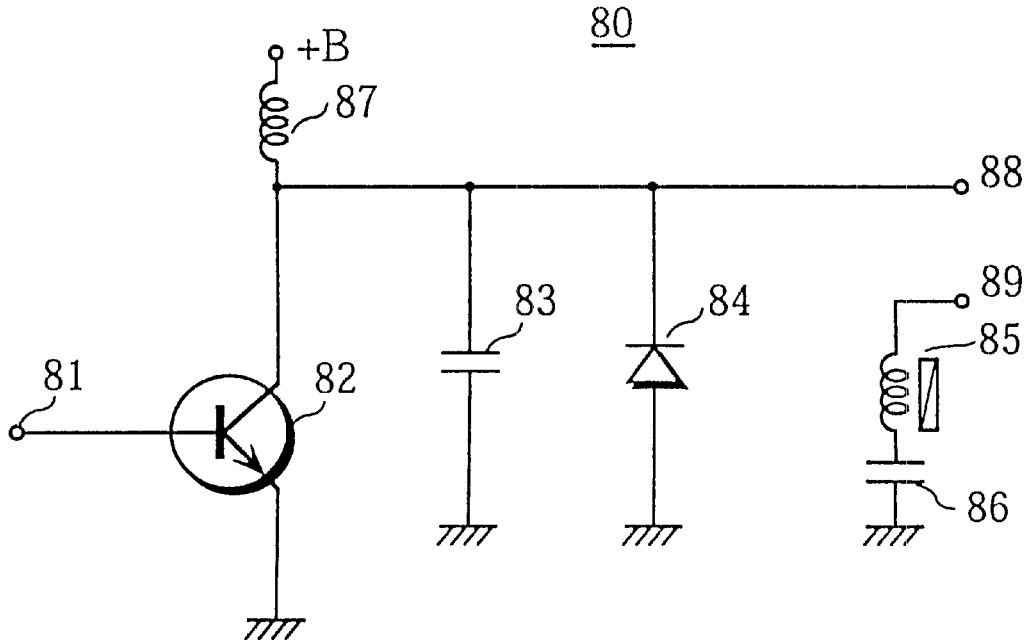
FIG. 11B shows a horizontal output circuit for supplying a horizontal deflection current to the horizontal deflection coil and the differential coil.

FIG. 11B shows a typical example of a horizontal output circuit that is provided at the final stage of the horizontal deflection circuit. A pulse voltage synchronized with a horizontal synchronizing signal is applied by a horizontal drive circuit (not shown) to a base 81 of a transistor 82 used for a switching. A positive direct current is supplied to a collector of the transistor 82 via a choking coil 87 that is used for eliminating alternating current components. The transistor 82 is brought into conduction every time the pulse voltage is applied to the base 81. A condenser 83 is given a charge of electricity while the transistor 82 is not conducting, and discharges electricity while the transistor is conducting. Thus, a charge/discharge operation is repeated in synchronization with the pulse voltage, so that a well-known sawtooth horizontal deflection current is generated.

A damper diode 84 connected in parallel to the condenser 83 is brought into conduction when a voltage with a reversed polarity is applied exceeding a predetermined value. With the conduction by the damper diode 84, a short is caused in an LC circuit that includes the deflection coils 2*a* and 2*b* and the condenser 83, thereby preventing occurrence of unnecessary resonance.

An output terminal 89 is grounded via a linearity correction circuit that includes a linearity coil 85 and a condenser 86 that are connected in series. The linearity correction circuit is a well-known circuit for correcting a deflection current to attain the linearity for the horizontal deflection of the electron beams. The linearity coil 85 is made of a saturable coil, and the self inductance of the coil 85 varies in accordance with saturation levels at respective points of the deflection current. Taking advantage of the variations in its self inductance, the linearity coil 85 attains the linearity for the deflection current. The condenser 86 corrects the deflection current into an S-shaped manner so as in turn to correct deflection distortion occurring to the central, right, and left parts of the front panel 1*a*.

In general, such a horizontal output circuit is provided for a display device, separately from a CRT device. The generated horizontal deflection current is supplied to the horizontal deflection coils 2*a* and 2*b* and the differential coil 50 via the terminals 63 and 64 (see FIG. 11A) that are connected to the output terminals 88 and 89 in a detachable manner.

Figure 12:
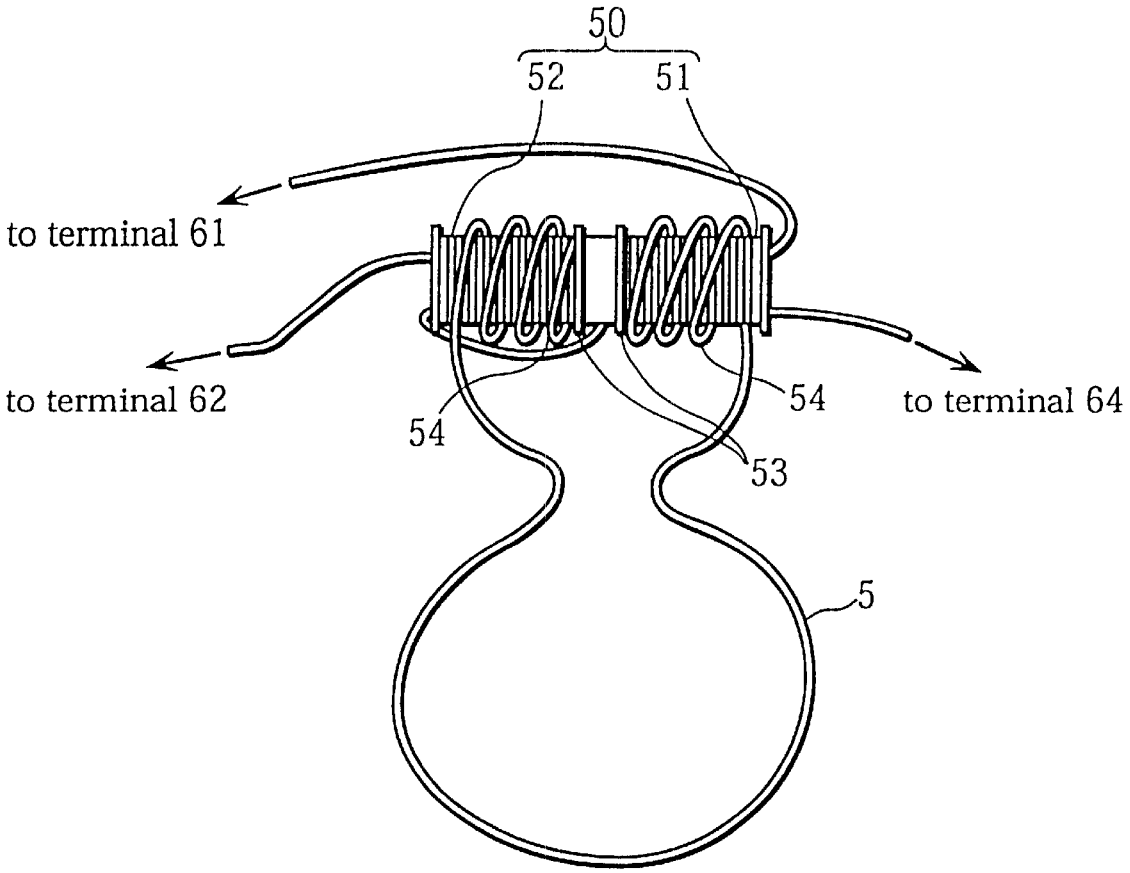
FIG. 12 shows that a part of the closed-loop coil is set around the differential coil in the second embodiment.

FIG. 12 shows that a part of the closed-loop coil 5 is set around the differential coil 50. The wire consisting the differential coil 50 is wound separately around two coil bobbins 53 to form first and second differential coils 51 and 52. Then, a part of the closed-loop coil 5 is set around the first and second differential coils 51 and 52 to form an induction coil part 54. A part of the closed-loop coil 5 may be set around one of the first and second differential coils 51 and 52. The induction coil part 54 is formed so that an electromotive force is produced in a direction so as to generate a magnetic field for canceling a magnetic field escaping as leakage from the deflection coils 2*a* and 2*b*.

Figure 13:
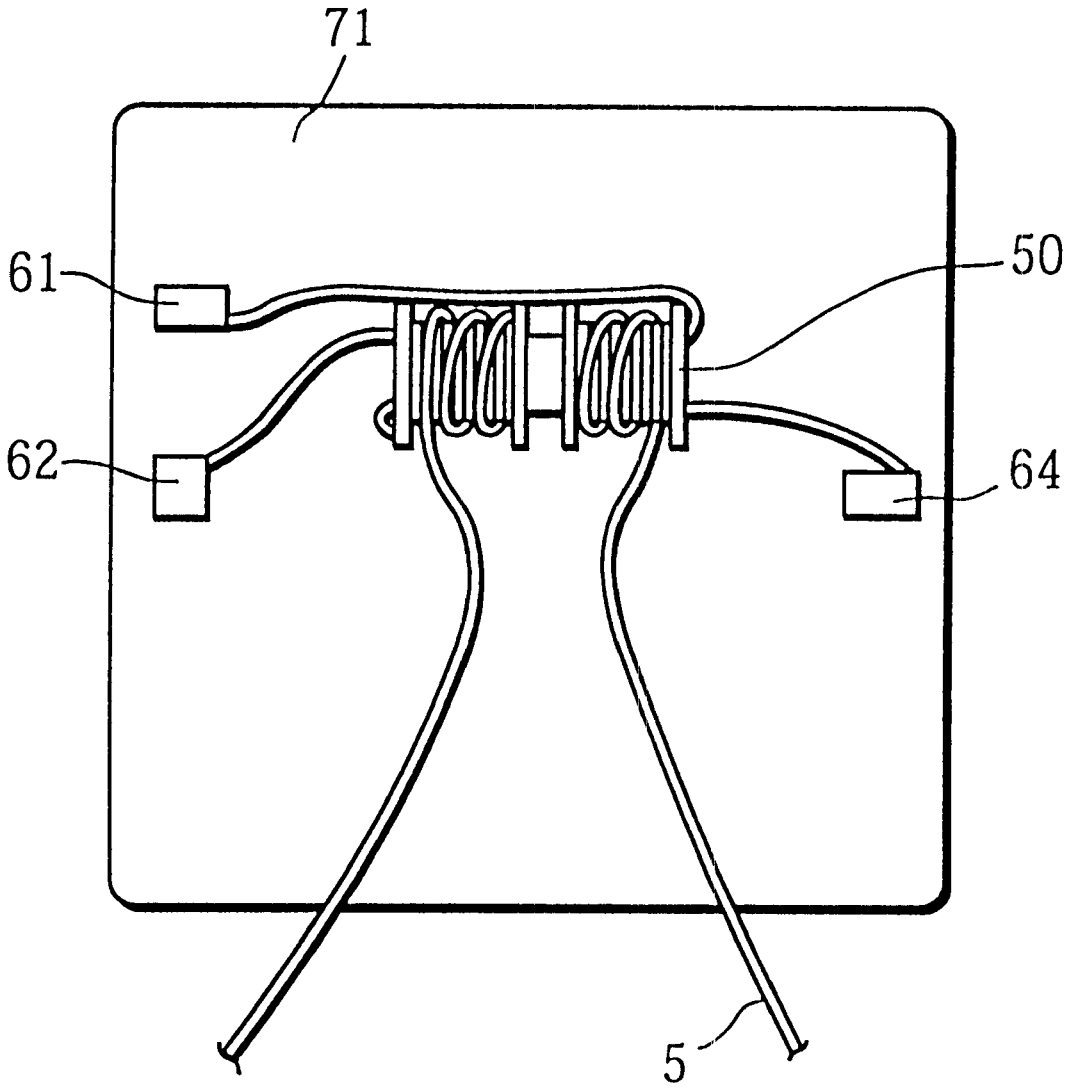
FIG. 13 shows a construction example of a magnetic coupling part between the differential coil and the closed-loop coil in the second embodiment.

FIG. 13 shows a construction example of a magnetic coupling part of the first and second differential coils 51 and 52 and the closed-loop coil 5. The differential coil 50 around which a part of the closed-loop coil 5 has been set is fixed to the board 71 made of insulation material, such as bakelite. The board 71 further includes the terminals 61 and 62 connected to the horizontal deflection coils 2*a* and 2*b*, and the terminal 64 connected to the horizontal deflection circuit.

As explained in the first embodiment with reference to FIG. 6, the cancel magnetic field 8 generated by means of the current passing through the closed-loop coil 5 cancels the magnetic field leakage 7 from the horizontal deflection coil 2. The present embodiment is different from the first embodiment in that the cancel magnetic field 8 in the present embodiment is generated with a higher intention by passing the current, resulting from an induced voltage generated by the induction coil part 54, through the closed-loop coil 5. With the induced voltage, the closed-loop coil 5 generates an electric field in the direction opposite to the electric field leakage, so that the electric field leakage can be also canceled.

<Experiments>

An experiment was conducted using a 40-centimeter (17-inch) computer monitor employing the CRT device of the present embodiment. As is the case with the experiment in the first embodiment, the magnetic field leakages were measured to see the reduction effect in comparison with a conventional device.

A differential coil used in the experiment was made by winding a litz wire around a cylindrical bobbin having a space inside with an inner diameter of 6 mm. The litz wire was made by tying twelve copper wires in a bundle, the thickness of each copper wire being $\phi 0.25$ mm. A screw-in magnet is set inside the space of the bobbin so that bias of inductance can be variably controlled. For the present experiment, the inductance was set at about 15 $\mu$H. A part of the closed-loop coil 5 was set as an induction coil around the differential coil so that an electromotive force was produced for canceling the magnetic and electric field leakages.

In the present experiment, the induction coil part 54 consisted of 30 turns, and an induced voltage of about 10 V was obtained as the peak voltage. By the application of the induced voltage to the rest of the closed-loop coil 5, the cancel magnetic and electric fields are generated for canceling the magnetic and electric field leakages. FIG. 14 and FIG. 15 respectively show the measurement results of the magnetic and electric field leakages.

As shown in the table of FIG. 14, the magnetic field leakage at the 0° measurement position, at which the leakage is the greatest, was reduced to 19.3 nT while it was 22.9 nT in the case of the conventional device. Meanwhile, as shown in the table of FIG. 15, the electric field leakage was 0.8 V/m at a distance of 30 cm in front of the CRT device. This leakage value is below the limit of 1.0 V/m prescribed for this position (at a distance 30 cm in front of the CRT device) in the TCO standard and also below the limit of 2.5 V/m prescribed for this position in the MPR II standard.

In the second embodiment, the closed-loop coil 5 is magnetically coupled to the differential coil 50. However, when the horizontal deflection circuit includes a coil through which a current varying in synchronization with the horizontal deflection current passes, the closed-loop coil 5 may be wound around the coil. For example, the horizontal deflection circuit may include a coil, such as the linearity coil 85 (see FIG. 11B) connected to the horizontal deflection coil in series or the choking coil 87 that changes the amount of passing current in accordance with the variations in the pulse voltage.

In the second embodiment, the closed-loop coil is set only at the upper part of the CRT 1. It should be obvious that the magnetic and electric field leakages can be effectively reduced by setting the closed-loop coil at the lower part of the CRT 1 as well. In this case, a part of the closed-loop coil set at the lower part of the CRT 1 is not necessarily set around the differential coil 50. This is because the magnetic field leakage can be adequately canceled by means of the closed-loop coil set at the upper part of the CRT 1.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A cathode ray tube comprising:

a cathode ray tube that has a front panel with an effective display region contained within the front panel;

an electron gun that is set inside a neck of the funnel projects electron beams onto an inner surface of the front panel;

a deflection yoke that is set on the funnel at the neck and deflects the electron beams projected by the electron gun; and a cancel coil that has at least one closed-loop coil, makes an interlinkage with a magnetic field leakage that escapes from the deflection yoke, and generates a magnetic field in a direction so as to cancel the magnetic field leakage, said closed-loop coil is a one-turn coil that lies in a substantially flat surface and is electrically grounded, wherein said closed-loop coil is set at either a first position or a second position, the first position having a part of the closed-loop coil running across the front panel and along a top edge of the effective display region of the front panel, and the second position having a part of the closed-loop coil running across the front panel and along a bottom edge of the effective display region.

2. The cathode ray tube device of claim 1, wherein the closed-loop coil further runs near right and left corners of the front panel and near an opening of the deflection yoke at a front panel side.

3. The cathode ray tube device of claim 1 further comprising:

a reinforcing band that is set on an outer edge of the front panel;

wherein first and second ears are formed on the reinforcing band at predetermined positions respectively corresponding to upper right and left corners of the front panel, wherein the closed loop coil runs along the top edge of the effective display region, under the first and second ears, and near an opening of the deflection yoke at a front panel side.

4. The cathode ray tube device of claim 1 further comprising:

a reinforcing band that is set on an outer edge of the front panel;

wherein first and second ears are formed on the reinforcing band at predetermined positions respectively corresponding to lower right and left corners of the front panel, wherein the closed-loop coil runs along the bottom edge of the effective display region, above the first and second ears, and near an opening of the deflection yoke at a front panel side.

5. The cathode ray tube device of claim 1 further comprising:

a correction coil that is connected in series with a horizontal deflection coil of the deflection yoke and used for correcting cross-misconvergence, wherein another part of each closed-loop coil is magnetically coupled to the correction coil so that the cancel coil generates the magnetic field in a direction so as to cancel the magnetic field leakage.

6. The cathode ray tube device of claim 1 wherein the closed-loop coil lies in an approximately parallel plane and encircles a vertical extension of a plane traverse to an optical axis of the electron gun at an outer surface of the cathode ray tube.

7. The cathode ray tube device of claim 1 wherein a closed-loop coil is set at both the first position and the second position.

8. The cathode ray tube device of claim 7 wherein the closed-loop coils lie in approximately parallel planes traverse to a vertical surface of the cathode ray tube.

9. A cathode ray tube device comprising:

a cathode ray tube that has a front panel with an effective display region and a funnel;

an electron gun that is set inside a neck of the funnel and projects electron beams onto an inner surface of the front panel to perform a raster scan of the effective display region;

a deflection yoke that is set on the funnel at the neck and deflects the electron beams projected by the electron gun; and a pair of cancel coils, each including a single turn closed-loop coil which is directly grounded and situated in a plane approximately parallel to an axis of the cathode ray tube, each cancel coil makes an interlinkage with a magnetic field-leakage that escapes from the deflection yoke, and generates a magnetic field in a direction so as to cancel at least a portion of the magnetic field leakage, wherein one cancel coil is positioned at a top of the cathode ray tube with a part of the closed-loop coil arranged across a front surface of the front panel and just above a top edge of the effective display region of the front panel, and the other cancel coil is positioned at a bottom of the cathode ray tube with a part of the closed-loop coil arranged across a front surface of the front panel and just below a bottom edge of the effective display region.

* * * * *